United States Patent [19]

Laspeyres

[11] Patent Number: 4,569,657

[45] Date of Patent: Feb. 11, 1986

[54] PLATE WITH ALVEOLAR RADIATING FACE FOR RADIANT BURNER

[75] Inventor: Marc Laspeyres, Herlies, France

[73] Assignee: Solaronics Vaneecke, Armentieres, France

[21] Appl. No.: 619,559

[22] PCT Filed: Oct. 11, 1983

[86] PCT No.: PCT/FR83/00205

§ 371 Date: Jun. 5, 1984

§ 102(e) Date: Jun. 5, 1984

[87] PCT Pub. No.: WO84/01613

PCT Pub. Date: Apr. 26, 1984

[30] Foreign Application Priority Data

Oct. 11, 1982 [FR] France ..... 82 17010

[51] Int. Cl.[4] ..... F23D 3/40

[52] U.S. Cl. ..... 431/326

[58] Field of Search ..... 431/328, 326; 126/92 AC; 239/145

[56] References Cited

U.S. PATENT DOCUMENTS

| | | | |
|---|---|---|---|
| 2,122,132 | 6/1938 | Docking | 431/328 |
| 4,063,873 | 12/1977 | Naito | 431/328 |

FOREIGN PATENT DOCUMENTS

| | | | |
|---|---|---|---|
| 710536 | 6/1968 | Belgium . | |
| 1570721 | 6/1969 | France . | |
| 2165626 | 8/1973 | France . | |
| 57-02711 | 8/1982 | Japan . | |
| 1062812 | 3/1967 | United Kingdom . | |
| 737706 | 6/1980 | U.S.S.R. | 431/328 |

*Primary Examiner*—Randall L. Green

*Attorney, Agent, or Firm*—Frost & Jacobs

[57] ABSTRACT

The alveoli of a plate having an alveolar radiating face are provided in the front face of the plate according to a family of patterns regularly distributed in rows, generally different, rows of holes, all the holes existing in the plate opening out totally or partially and in all regular distribution conditions of staggered, checkered or offset holes in the rows, into corresponding alveoli each containing a central hole; the base of the alveoli has an hexagonal or quadrilateral shape, regular or irregular, and the alveoli may have depth profiles which correspond to revolution volumes or facet volumes.

7 Claims, 16 Drawing Figures

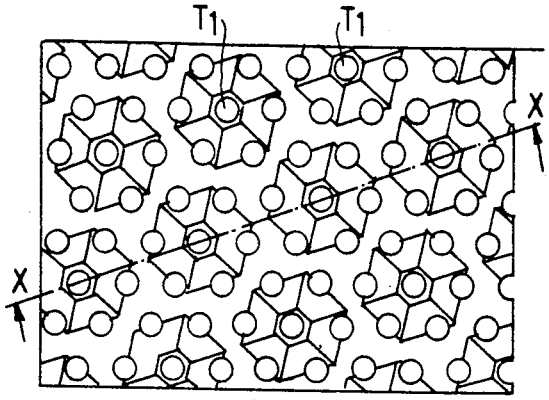
FIG.8
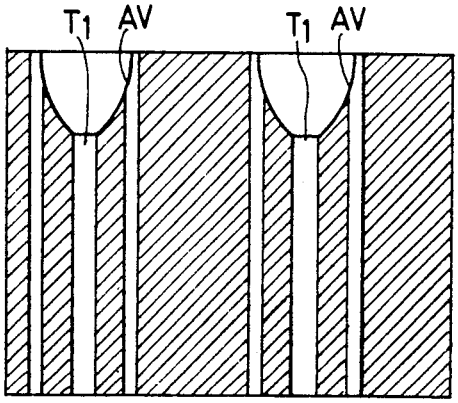
FIG.11
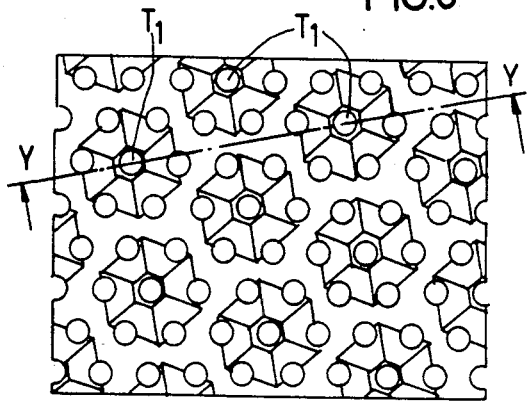
FIG.9
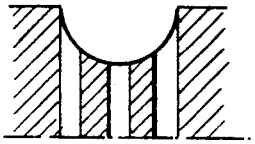
FIG.12A
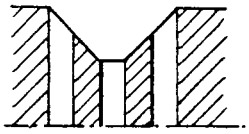
FIG 12B
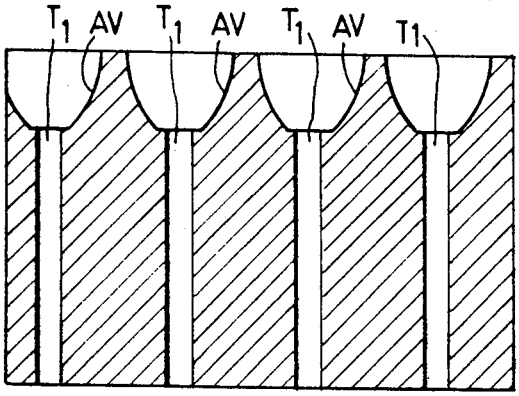
FIG.10
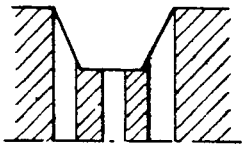
FIG.12C
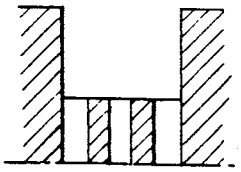
FIG.12E
FIG.12D
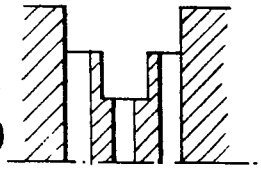

PLATE WITH ALVEOLAR RADIATING FACE FOR RADIANT BURNER

BACKGROUND OF THE INVENTION

1. Field of the Invention

The present invention relates to a plate with a alveolar radiating face for radiant burners.

2. Prior Art

Radiant burner plates generally have rows of through holes serving to channel the mixture of fuel and combustion agent from the rear face of the plate to the radiating face. In order to increase the radiating power of the plate, the prior art has already contemplated in the front face of the plate, cavities or alveoli forming a plurality of holes. A hole which has been truncated before leading out onto the front face of the plate in fact distributes the flame produced by it in such a manner that it heats the surfaces surrounding the cavity or alveolus.

Nevertheless, in known plates the alveoli formed leave between them a certain number of holes which do not increase the radiating power of the plate.

The present invention seeks to obviate the abovementioned and other disadvantages of known arrangements with the aid of a radiant burner plate having an alveolar front face and made of a ceramic material, in which rows of holes are formed for the passage of the fuel-combustion agent mixture and in which it is possible to provide alveoli regularly disposed in rows and ensuring the participation of all the holes existing in the plate, irrespective of the staggered, squared or offset pattern of the rows of holes.

SUMMARY OF THE INVENTION

Maximum transfer of heat between the flames and the plate is obtained by increasing the wall surface of contact of the material of the plate, with all the combustion products.

This results in raising the temperature of these walls and consequently, for the same power consumption, there is a substantial increase in the radiation power, and therefore of the radiation output.

In addition, a reduction of losses through conduction to the rear of the plate is achieved, since the amount of material existing between two adjacent alveoli is reduced to a minimum and also because emissivity is increased by the particularly pronounced relief of the radiating face of the plate.

For the purpose of solving the problem according to the present invention, the following geometrical considerations are taken as the starting point:

Given a plate comprising a plurality of rows of holes, which may be distributed in any squared, staggered or offset arrangement, as will be made clear later on, it is first necessary to define the distribution of the bases of the alveoli on the front face of the plate in relation to these rows. Any hole in a row is selected, and either four or six holes neighbouring this selected hole are considered; nevertheless, it should be noted that this alternative has no limitative effect on the invention, because it is possible to start with either number of neighbouring holes in order to find a satisfactory arrangement of alveoli.

Starting from the centre of any hole selected, vectors joining this centre to the centres of the neighbouring holes are traced. Four or six vectors characterized by their direction, their sense and their length are thus obtained. The figure formed by segments joining the ends of the said vectors defines what will hereinafter be called the theoretical alveolus base. Depending on the number of vectors, this figure has the shape of a quadrilateral or hexagon. If a given vector is considered, there will always be in this figure, in relation to this vector, a vector placed on the right, a vector placed on the left, and a vector situated opposite, which will be called the "contrary vector" because it does not always coincide with the opposite vector in the mathematical sense of the term, particularly when the figure has the shape of an irregular polygon.

Thus, according to the invention, the radiant burner plate having an alveolar front face, composed of a ceramic material and having rows of holes for the passage of the combustion agent/fuel mixture, is characterized in that the alveoli are arranged in the radiating front face of the plate in accordance with a family of patterns with distribution in rows which are generally different from the rows of holes, in that all the holes existing in the plate lead, each in whole or in part, and under any conditions of regular staggered, squared or offset distribution of the rows of holes, into the corresponding alveoli, each of which contains a central hole, and in that the family of patterns of regular distribution of alveoli in the radiating face of the plate is determined in the following manner:

a theoretical alveolus base is defined by tracing, from the centre of a given hole, four or six vectors joining that centre to the centres of the four or six neighbouring holes selected, and joining the ends of these four or six vectors thus selected, with an associated right-hand vector, a left-hand vector and a contrary vector;

from the end of each of these selected vectors there is traced a vector of the same length, oriented in the opposite sense to their associated contrary vector;

from the end of each of these new vectors there is traced either a vector identical to their associated right-hand vector or a vector identical to their associated left-hand vector, the points which correspond to the ends of the last-mentioned vectors defining, in each of the two possibilities thus created, the centres of the theoretical bases of the alveoli adjacent to the starting alveolus and similarly oriented, this orientation being defined by that of the largest diagonal passing through the centre of the alveolus, and by then operating step by step, one of the two patterns of regular distribution of alveoli is determined, depending on the selection of one or the other of the two possibilities.

According to other features of the invention:

the theoretical base of the alveoli has the shape of a regular or irregular hexagon, depending on the degree of offset of the different rows of holes in the plate;

the theoretical base of the alveoli has the shape of an irregular quadrilateral or of a rectangle or square, depending on the degree of offset of the different rows of holes in the plate;

the real base of the alveoli is defined either by a circle or by a polygon similar to that of the theoretical base, said circle or polygon having to intersect or contain each of the holes whose centres are situated on the periphery of the theoretical alveolus base;

in depth, each alveolus has a cylindrical, conical, or hemispherical profile or the profile of some other volume of revolution;

each alveolus has in depth a faceted profile;

each alveolus has in depth a profile constituted by one or more complete or truncated volumes of revolution, for example a cylindroconical profile;

the angle at the summit of the alveolus bottom, starting from the centre of the central hole of said alveolus, is beteen about 30° and 180°;

the apertures provided in the plate are preferably cylindrical and have a diameter of between about 0.4 and 5 mm;

the depth of the alveoli is betweeen 0.5 mm and 3/5ths of the thickness of the plate;

the equivalent diameter of the theoretical alveolus base is defined by the sum of the diameters of two neighbouring holes and the thickness of material between these two holes;

in order to set back the backflash limit by increasing the speed of flow of the fuel-combustion agent mixture, one or more apertures of each alveolus is or are closed.

Other advantages and characteristics of the invention will emerge from the following description given by way of non-limitative example and with reference to the accompanying drawings, in which:

BRIEF DESCRIPTION OF THE DRAWINGS

FIGS. 8 and 9 are partial plan views showing, for one and the same arrangement of the rows of holes and one and the same theoretical alveolus base, two real hexagonal alveolus patterns which are possible, in accordance with the present invention;

FIGS. 10 and 11 show two cross-sections of the plates shown in FIGS. 8 and 9, taken respectively on the lines X—X and Y—Y, in such a manner as to show the depth profile of the alveoli, and FIGS. 12A to 12E are cross-sections of plates showing different depth profiles of the alveoli.

DESCRIPTION OF THE PREFERRED EMBODIMENTS

Figure 1:
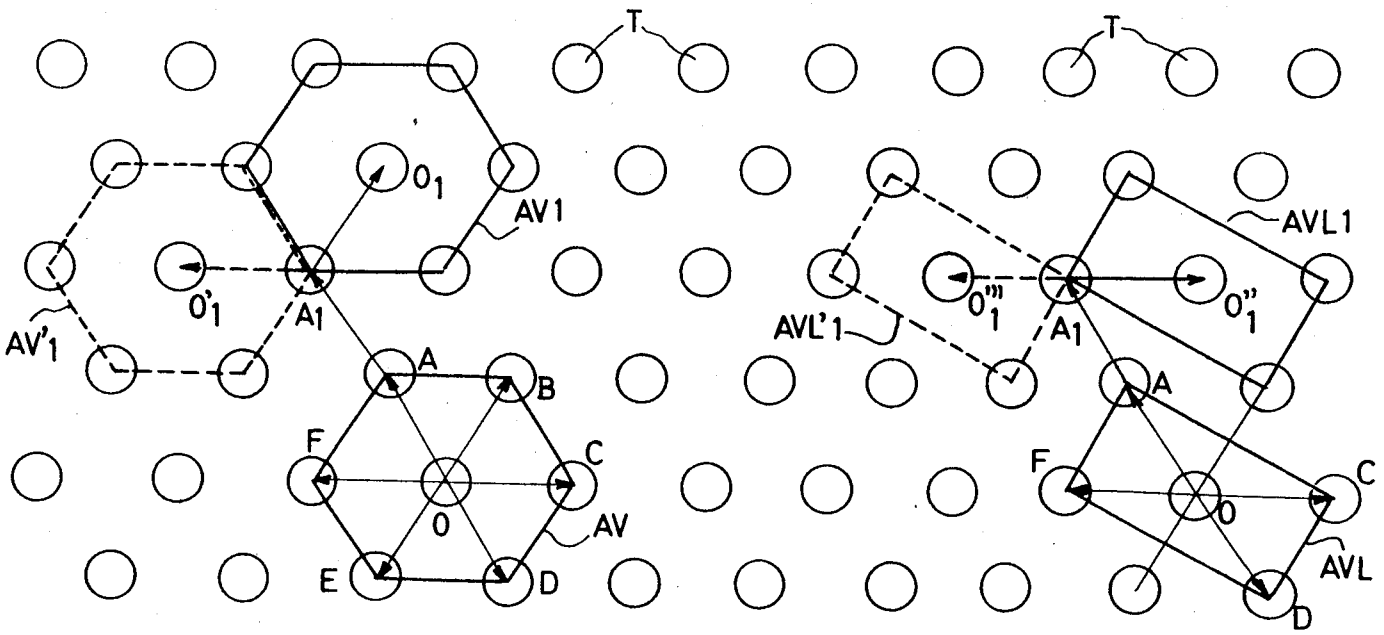
FIG. 1 is a partial plan view of the radiating face of a radiant burner plate, showing the process of determination of the patterns of regular distribution of the alveoli in the plate.
Figure 2:
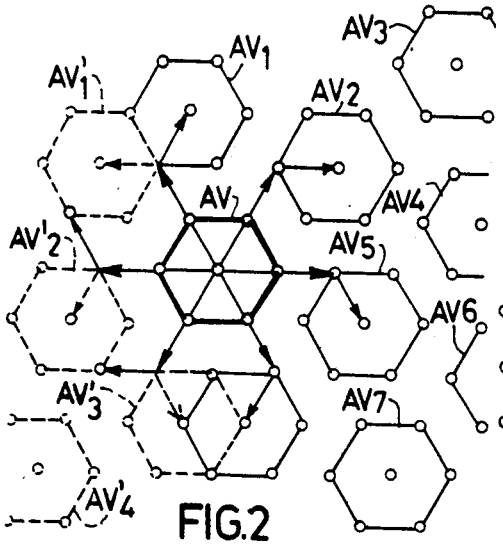
FIGS. 2 and 3 are partial plan views showing the different distributions of alveoli which can be obtained in the case of equilateral staggering of the holes in the rows.

FIG. 1 shows in plan view a part of a plate for a radiant burner, comprising a plurality of rows of holes designated T, and the geometrical processes are shown which make it possible to obtain the patterns of regular distribution of alveoli in the radiating face of the plate according to the present invention.

For a given hole, such as the hole whose centre is designated O, it can be considered that six neighbouring holes exist, whose centres are designated respectively A, B, C, D, E and F. In order to define clearly the relative positions of the holes, there are drawn, from the centre O of the given hole, vectors connecting this centre to the centres of the neighbouring holes, thus obtaining the vectors $\overrightarrow{OA}$, $\overrightarrow{OB}$, $\overrightarrow{OC}$, $\overrightarrow{OD}$, $\overrightarrow{OE}$ and $\overrightarrow{OF}$.

The alveoli which are to be formed in the plate are defined by their theoretical base, that is to say their geometrical base, and their depth profile. The real shape of the alveoli is then determined from the theoretical profile, taking into account the conditions of production, such as technological conditions of machining, moulding and other methods of formation.

In the embodiment shown in FIG. 1, there are two cases of figures, depending on whether:

the end points of the six vectors are joined together, thereby giving the theoretical alveolus base a hexagonal shape AV, as indicated in the left-hand part of FIG. 1, or only four vectors $\overrightarrow{OA}$, $\overrightarrow{OC}$, $\overrightarrow{OD}$, $\overrightarrow{OF}$ are used, and a theoretical alveolus base is then obtained which has a quadrilateral shape AVL, as indicated in the right-hand part of FIG. 1, the main orientation of the quadrilateral being defined by the largest diagonal passing through the centre of the alveolus, that is to say AD in FIG. 1.

It will not be described how the different alveolus distribution patterns are obtained.

The starting point is a given vector $\overrightarrow{OA}$. For this vector $\overrightarrow{OA}$ there exist, in the case of all figures, a right-hand vector $\overrightarrow{OB}$, a left-hand vector OF, and a vector situated opposite $\overrightarrow{OD}$, which is called the contrary vector of the given vector because, although it is directly opposite the vector $\overrightarrow{OA}$ in the figure under consideration, it may happan that this vector is not placed in this precise geometrical condition, as is shown for example in FIGS. 6 and 7.

Starting from the end A of the vector $\overrightarrow{OA}$, a vector $\overrightarrow{AA_1}$ is drawn which is parallel to and has the same length as and the opposite sense to the contrary vector $\overrightarrow{OD}$. From the point $A_1$, a vector $\overrightarrow{A_1O_1}$ is drawn which is parallel to and has the same length and sense as the right-hand vector $\overrightarrow{OB}$. The point $O_1$ thus obtained is the centre of the theoretical base of a cell $AV_1$.

By operating in the same manner for the other five vectors starting from the point O, six neighbouring theoretical bases are finally obtained for a central theoretical base AV, and by then operating step by step there is obtained over the entire front flat of the plate an alveolus distribution pattern which involves all the holes, each of which leads in whole or in part into an alveolus, and which can be established for any pattern of distribution of the said holes, that is to say for any staggered, squared or offset pattern.

The distribution pattern corresponding to the point $O_1$ is not unique. Starting from the point $A_1$, it is in fact possible to draw a vector which is parallel to and has the same length and sense as the left-hand vector $\overrightarrow{OF}$, thus obtaining the vector $\overrightarrow{A_1O'_1}$. This point $O'_1$ constitutes the centre of a theoretical alveolus base designated $AV'_1$ in FIG. 1 and corresponding to another pattern of distribution of hexagonal alveoli.

In the right-hand part of FIG. 1, after definition of the theoretical alveolus base having the shape of a quadrilateral AVL, a given vector $\overrightarrow{OA}$ is selected, the vector $\overrightarrow{AA_1}$ is drawn which is parallel to and has the same length as and the opposite sense to the contrary vector $\overrightarrow{OD}$, and then a vector is drawn which is identical to the right-hand vector $\overrightarrow{OC}$, so as to reach the point $O''_1$, or else a vector identical to the left-hand vector $\overrightarrow{OF}$, so as to reach the point $O'''_1$. These points $O''_1$ and $O'''_1$ constitute the centres of theoretical alveolus bases designated respectively $AVL_1$ and $AVL'_1$ and defining two alveolus distribution patterns in the form of quadrilaterals.

In FIGS. 2 to 7 are shown a number of alveolus distribution patterns which can be obtained by the patterns of distribution of the holes and rows in the plate. Thus, in FIG. 2 there is a distribution of holes corresponding to equilateral staggering, and in this case alveoli in the shape of regular hexagons are obtained. The alveoli of the type obtained from the right-hand vector are designated $AV_1$ to $AV_7$ and shown in solid lines, while the alveoli of patterns obtained from the left-hand vector are designated $AV'_1$ to $AV'_4$ and shown in broken lines.

Figure 3:
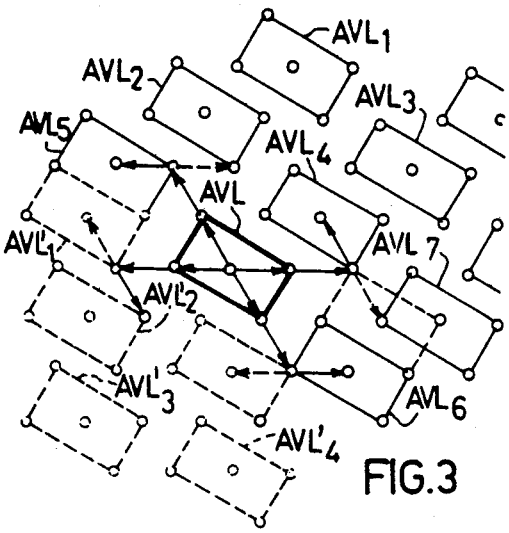

In FIG. 3, starting with the same pattern of equilateral staggering of the holes in the rows and selecting a theoretical alveolus base AVL in the form of a quadrilateral, two distribution patterns have been obtained which correspond on the one hand to the alveoli $AVL_1$ to $AVL_7$ in solid lines and to the alveoli $AVL'_1$ to $AVL'_5$.

Figure 4:
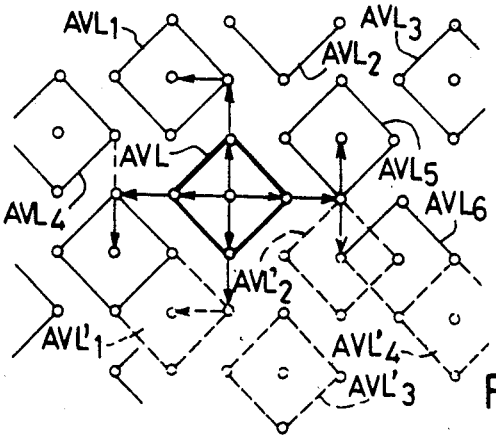

FIG. 4 shows the patterns obtained with a distribution of holes corresponding to squaring, the theoretical alveolus base having the shape of a square.

Figure 5:
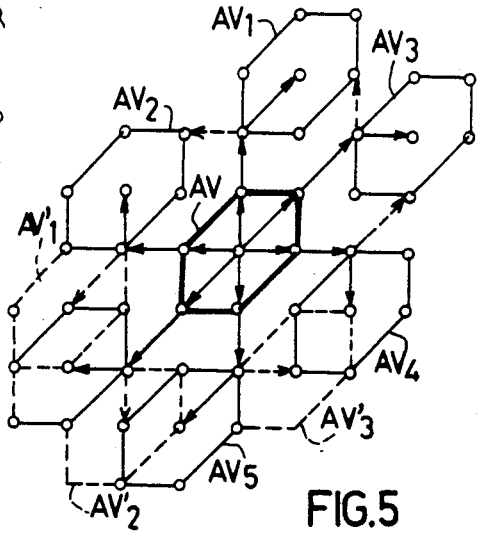
FIGS. 4 and 5 are partial plan views showing the different distributions of alveoli which can be obtained in the case of a squared arrangement of the holes in the rows.

For the same squared distribution of the holes, FIG. 5 shows alveolus distribution patterns obtained by selecting for the theoretical alveolus base the shape of a hexagon of flattened profile.

Figure 6:
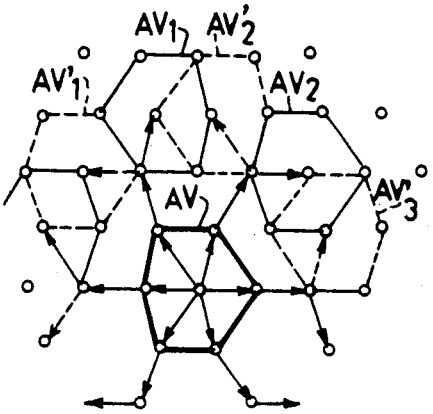
FIGS. 6 and 7 are partial plan views showing the different distributions of alveoli which can be obtained in the case of any offsetting of the rows of holes.
Figure 7:
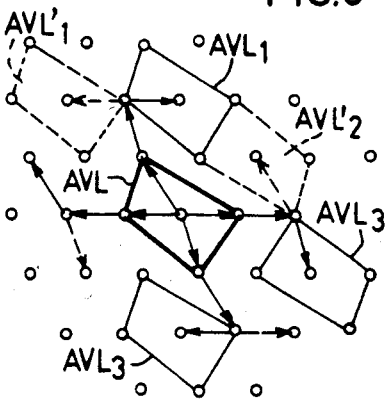

FIGS. 6 and 7 show alveolus distribution patterns obtained in the case of any offsetting of the holes in the different rows. In FIG. 6 the theoretical cell base is in the form of an irregular hexagon, while in FIG. 7, with the same distribution of holes, a shape of an irregular quadrilateral has been selected as the theoretical alveolus base.

Once the theoretical alveolus patterns have been determined, their real shapes must be defined and thermal and technological considerations are brought into play. The plates according to the invention are made by moulding under pressure, and it is obvious that the distribution and shape of the alveoli have an influence on the manufacturing process, because they condition the formation of the corresponding parts of the mould, which must have optimum efficiency and reliability while having the lowest possible cost price.

Some examples of the production of the plate according to the invention will now be given below. As indicated in FIGS. 8 and 9, which correspond to a distribution of the holes with equilateral staggering, the shape of a regular hexagon has been adopted for the real alveolus base, the pattern shown in FIG. 8 being obtained by tracing with the aid of the right-hand vector and the pattern shown in FIG. 9 being obtained by tracing with the aid of the left-hand vector. Comparison of FIGS. 8 and 9 with FIG. 2, which gives the patterns of distribution of the theoretical alveolus bases in the same case, shows that the real hexagons have been slightly turned about their centres, relative to the theoretical hexagons, this angular offsetting being justified by machining considerations. In the example in question, the alveoli have a depth profile which is indicated in FIGS. 10 and 11, FIG. 10 being a cross-section taken on the line X—X in FIG. 8, while FIG. 11 is a cross-section taken on the line Y—Y in FIG. 9. Starting from the base in the form of a regular hexagon, each alveolus is thus bounded by incurved facets starting from the sides of the hexagon and ending at a bottom defined by a plane situated at a distance H from the front face of the plate, the intersections of the facets with the said bottom plane defining small hexagons, which can be seen in FIGS. 8 and 9 and are respectively described around the central holes of the alveoli, these holes being visible at T1 in FIGS. 8, 9, 10 and 11.

In order to form these faceted alveoli, it is necessary to make a mould punch provided with projecting parts corresponding to the said alveoli. There are various solutions for the production of a mould punch of this kind, particularly:

machining from the solid by milling or by electroerosion, for example, lost-wax moulding of members whose positive shape corresponds to the negative profile of the alveoli, and fastening these members in a punch plate, after the style of turbine blades.

In the example under consideration the form milling process was adopted and, in order to permit the passage of the milling cutter, the solution adopted consisted in angularly offsetting the base hexagons of the alveoli.

In FIGS. 12A to 12E, some examples are given of depth profiles which it is possible to adopt for the alveoli, particularly a hemispherical profile, a truncated cone profile, a stepped cylinder profile, and a plain cylinder profile. It is possible to envisage other profiles, for example profiles consisting of surfaces of revolution, such as paraboloids, or composite profiles such as cylindroconical profiles.

For the determination of the depth profile it is possible to make use of various parameters. In particular, the angle at the summit of the alveolus bottom, starting from the centre of the central hole of said alveolus, is between about 30° and 180°. The depth of the alveolus should preferably be between 0.5 mm and 3/5ths of the thickness of the plate. In addition, the apertures formed in the plate are preferably cylindrical and have a diameter between about 0.4 and 5 mm. The equivalent diameter of the theoretical alveolus base is defined by the sum of the diameters of two neighbouring holes and the thickness of material between these two holes. Nevertheless, it is obvious that all dimensions indicated above definitely do not constitute limitations of the invention.

Furthermore, it should be noted that in order to increase the speed of flow of the fuel-combustion agent mixture in the holes and thus to reduce the back-flash limit, it is possible to close one or more apertures in each alveolus.

The invention is obviously not limited to the examples of embodiment described above and illustrated, on the basis of which it will be possible to provide other forms and other embodiments, without thereby departing from the scope of the invention.

Thus, the holes need not be situated on the periphery of the alveolus, as in most of the foregoing illustrative examples, particularly at the summits of the perimeter of the alveolus, but the holes may also be disposed inside the alveolus.

I claim:

1. In a method for manufacturing a plate having an alveolar front face for radiant burners, which is composed of a ceramic material and has rows of holes for the passage of a combustion agent/fuel mixture, and in which the alveoli are arranged in the radiating front face of the plate in accordance with a family of patterns with regular distribution in rows, which are generally different from the rows of holes, in that all the holes existing in the plate lead, each in whole or in part and under any conditions of regular staggered, squared or offset distribution of the rows of holes, into the corresponding alveoli, each of which contains a central hole, the family of patterns of regular distribution of alveoli in the radiating face of the plate being determined by the following steps:

defining one of two possible theorical alveolus base patterns by selectively tracing from the center of a given hole, four or six vectors joining that center to the centers of the four or six neighboring holes, and joining the ends of each of these four or six vectors thus selected, with an associated right-hand vector, a left-hand vector and a contrary vector;

tracing from the end of each of these selected vectors a new vector of the same length, oriented in the opposite direction to its associated contrary vector;

tracing from the end of each of these new vectors either a vector identical and parallel to its associated right-hand vector or a vector identical to its associated left-hand vector, the points which correspond to the ends of the last-mentioned vectors defining, in each of the two possibilities thus created, the centers of the theoretical bases of the alveoli adjacent to the starting alveolus and similarly oriented, this orientation being defined by that of the largest diagonal passing through the center of the alveolus, and, repeating the above steps until one of the two patterns of regular distribution of alveoli is determined.

2. A method as set forth in claim 1, wherein the holes are chosen so as to obtain contiguous alveoli patterns selected among the hexagonal, square and rectangular patterns.

3. A method as set forth in claim 1, wherein the angle at the summit of the alveolus bottom, starting form the center of the central holes of said alveolus, is between about 30° and 180°.

4. A method as set forth in claim 1, wherein the apertures provided in the plate are cylindrical and have a diameter of between about 0.4 and 5 mm.

5. A method as set forth in claim 1, wherein the depth of the alveoli is between 0.5 mm and 3/5ths of the thickness of the plate.

6. A method as set forth in claim 1, wherein the equivalent diameter of the theoretical alveolus base is defined by the sum of the diameters of the two neighboring holes and the thickness of material between these two holes.

7. A method as set forth in claim 1, wherein in order to reduce the backflash limit by increasing the speed of flow of the fuel-combustion agent mixture, at least one hole of each alveolus is closed.

* * * * *